US005596979A

United States Patent [19]

Sobotka et al.

[11] Patent Number: 5,596,979

[45] Date of Patent: Jan. 28, 1997

[54] SOUND INHIBITOR BAFFLES

[75] Inventors: Stanley E. Sobotka, Flint; John G. Charles, Sr., Tyler, both of Tex.; Dale E. Nagel, Wampsville; James T. Kalin, Chittenango, both of N.Y.

[73] Assignee: Carrier Corporation, Syracuse, N.Y.

[21] Appl. No.: 573,980

[22] Filed: Dec. 18, 1995

[51] Int. Cl.[6] ..... F24C 3/00

[52] U.S. Cl. ..... 126/91 A; 126/116 R; 431/114; 431/347; 122/44.2; 122/155.2

[58] Field of Search ..... 431/114, 347; 126/91 A, 116 R; 122/44.2, 155.2

[56] References Cited

U.S. PATENT DOCUMENTS

| | | | |
|---|---|---|---|
| 2,230,221 | 2/1941 | Fitch | 122/155.2 |
| 2,262,530 | 11/1941 | Hamlink | 126/91 A |
| 4,486,167 | 12/1984 | McMurray et al. | 431/114 |
| 5,186,620 | 2/1993 | Hollingshead | 431/114 |
| 5,429,112 | 7/1995 | Rozzi | 126/91 A |

*Primary Examiner*—Carroll B. Dority

[57] ABSTRACT

A baffle is located in a recessed location relative to the inlet of a heat exchanger tube and facing the burner. The baffle is made of high temperature ceramic foam and has a plurality of flutes which define the flow path. In passing through the baffle, the velocity of the flame pattern is increased which reduces the noise level. The baffle also reduces $NO_x$ as a result of heat transfer to the baffle.

4 Claims, 1 Drawing Sheet

SOUND INHIBITOR BAFFLES

BACKGROUND OF THE INVENTION

In the complete combustion of common gaseous fuels, the fuel combines with oxygen to produce carbon dioxide, water and heat. There can be intermediate reactions producing carbon monoxide and hydrogen. The heat, however, can also cause other chemical reactions such as causing atmospheric oxygen and nitrogen to combine to form oxides of nitrogen or $NO_x$. While $NO_x$ may be produced in several ways, thermal $NO_x$ is associated with high temperatures, i.e. over 2000° K. The flame is zoned so that different parts of the flame are at different temperatures. $NO_x$ production can be reduced with the lowering of the peak flame temperature. The reduction in $NO_x$ is required because it is a prime component in the generation of photochemical smog and reduction can be achieved through turbulence of the gases being combusted and/or by heat transfer from the high temperature portion of the flame. Inserts have been placed in the inlet portions of the heat exchanger tubes facing the inshot burners of a fuel fired heating appliance such as a furnace. Associated with the burning process in a furnace environment and with structure to reduce $NO_x$ are problems with objectionable sound generation. U.S. Pat. No. 5,146,910 discloses a $NO_x$ reducing devices which "perform their $NO_x$ reducing functions without generating an appreciable amount of noise during operation of their associated furnace".

SUMMARY OF THE INVENTION

The present invention seeks first to lower the sound levels of the gas flames in the heat exchanger tubes and then to obtain the desired $NO_x$ reduction. The sound inhibitor baffle is made of a high temperature ceramic foam. The baffle is basically cylindrically shaped with a length to width ration of about four and with flutes forming the flow path portion of the baffle. The flow paths formed by the flutes have a length to width ratio in excess of fifteen.

It is an object of this invention to provide sound reduction of the gas flames in the tubes of a gas fired furnace.

It is another object of this invention to reduce $NO_x$ production. These objects, and others as will become apparent hereinafter, are accomplished by the present invention.

Basically, a generally cylindrical high temperature ceramic foam baffle having flutes is located in a recessed manner in the heat exchanger tubes of a gas furnace such that the flame enters the tube and is subsequently divided in flowing past the insert with the velocity of the flame pattern being increased. The baffle increases the turbulence of the flow thereby causing a change in the harmonic resonance of the tubes and reducing the sound level.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 2:
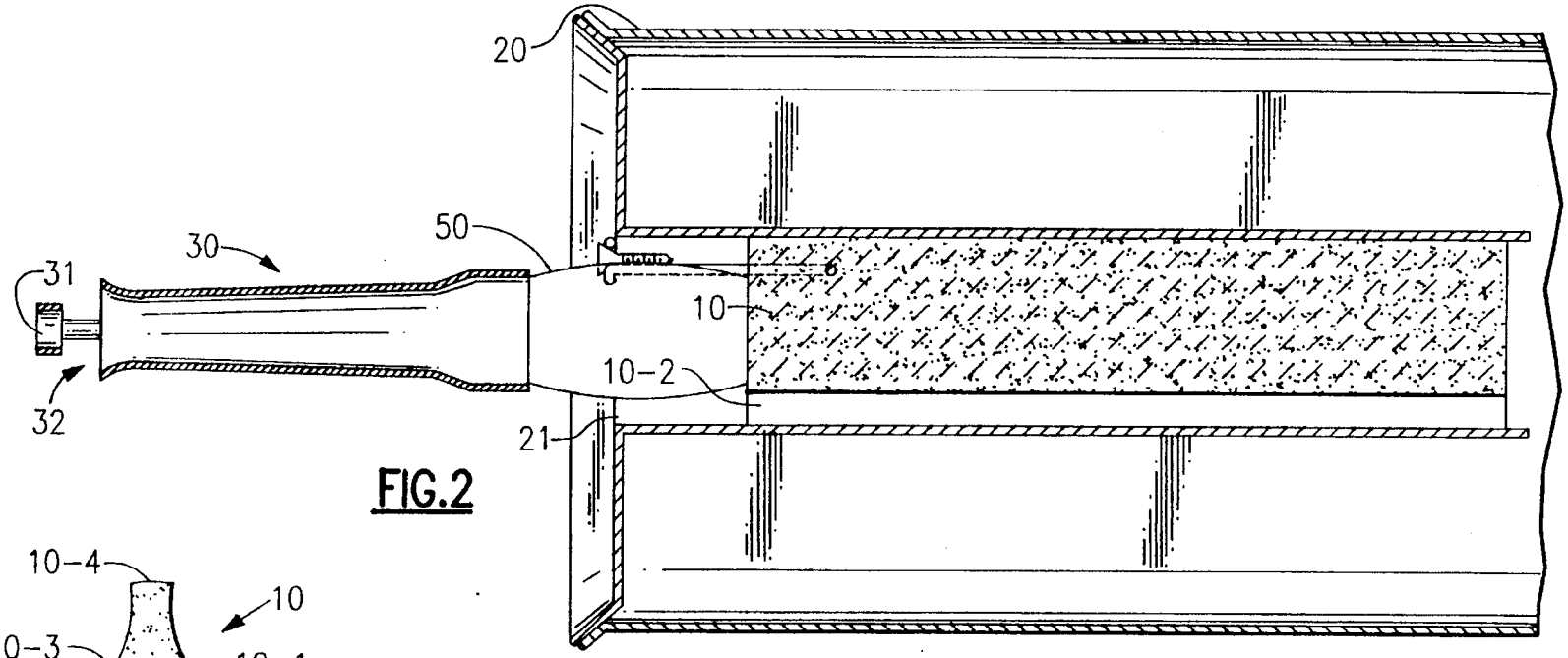
FIG. 2 is a vertical sectional view showing the insert in place.
Figure 3:
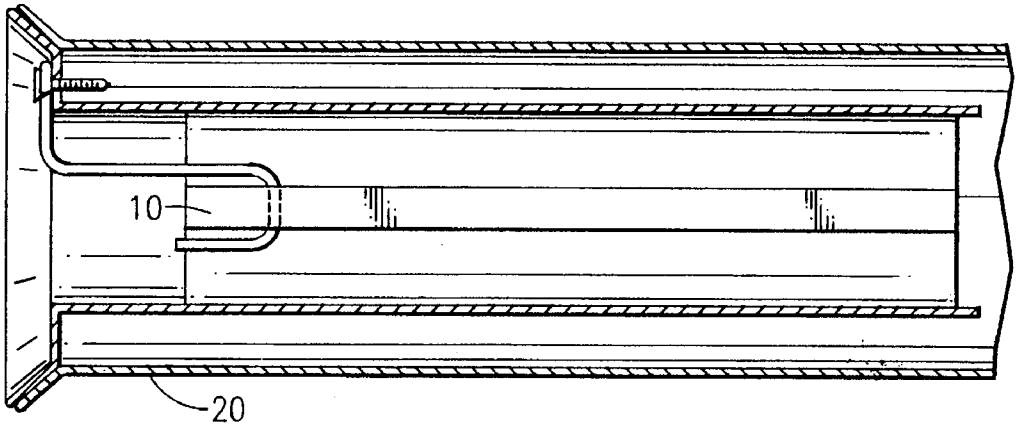
FIG. 3 is a horizontal sectional view showing the insert in place.
Figure 1:
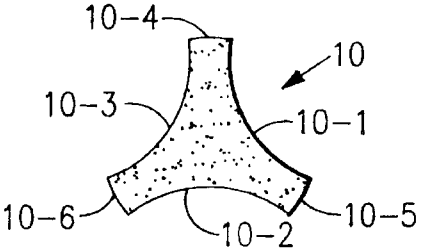
FIG. 1 is an end view of the insert.

In FIGS. 1–3, the numeral 10 generally designates the sound inhibitor baffle of the present invention. Baffle 10, in a preferred embodiment, is 2.125 inches in diameter and 8.5 inches long and made of high temperature ceramic foam such as a silicon carbide type foam. Flutes 10-1 to 10-3 are formed in baffle 10 and correspond to approximately 270° of the circumference of baffle 10. The flutes 10-1 to 10-3 are separated by circumferential sections 10-4 to 10-6 which are each approximately 30° in extent. The flutes 10-1 to 10-3 each make up less than one third of the cross section of the cylindrical baffle absent the flutes so that the flutes coact with the surrounding structure to form a relatively long flow path and a long contact time with baffle 10.

Baffle 10 is placed about 2.0 inches into the inlet 21 of heat exchanger 20 and is suitably held in place, as by U-shaped retainer 40. Retainer 40 may be made of stainless steel and prevents baffle 10 from moving into heat exchanger 20. Inshot burner 30 is spaced from the inlet 21 such that the burner's flame 50 goes into heat exchanger 20 and is then divided into a plurality of paths defined by flutes 10-1 to 10-3 so that turbulence and heat transfer take place which tends to reduce $NO_x$ and sound levels.

In operation, gaseous fuel is supplied under pressure to port 31 of burner 30. The gas supplied to port 31 passes annular opening 32 aspirating atmospheric air which is drawn into burner 30. The fuel-air mixture exits burner 30 in flame 50. Flame 50 enters heat exchanger 20 and the velocity of the flame pattern is increased as it contacts baffle 10 and divides into the flow paths defined by flutes 10-1 to 10-3. The porosity of baffle 10 causes flame turbulence which results in a better air mixture so that combustion is completed sooner with increased heat transfer to the baffle 10. Additionally, the heat transfer to the baffle 10 tends to reduce the flame temperatures and to lower the peak temperature and thereby reduce the production of thermal $NO_x$.

Although a preferred embodiment of the present invention has been described and illustrated, other changes will occur to those skilled in the art. It is therefore intended that the scope of the present invention is to be limited only by the scope of the appended claims.

What is claimed is:

1. Combustion means for a gas fired furnace comprising:

an inshot burner adapted to burn gaseous fuel and to produce a flame;

a heat exchanger having an inlet facing said burner;

a single baffle recessed in said heat exchanger in facing relationship with said burner so as to be within said flame;

said baffle being made of high temperature ceramic foam and having a plurality of flutes defining flow paths whereby said baffle coacts with said flame to increase the velocity of the flame pattern to reduce sound while causing turbulence and heat transfer which reduces $NO_x$ generation.

2. The combustion means of claim 1 wherein said flutes have a combined circumferential extent of approximately 270°.

3. The combustion means of claim 2 wherein said plurality of flutes is three flutes.

4. The combustion means of claim 3 wherein said baffle has a length to width ratio of at least four.

* * * * *